US011339797B2

(12) United States Patent
Iwakiri

(10) Patent No.: US 11,339,797 B2
(45) Date of Patent: May 24, 2022

(54) COMPRESSOR SCROLL SHAPE AND SUPERCHARGER

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 181 days.

(21) Appl. No.: 16/478,251

(22) PCT Filed: Mar. 28, 2017

(86) PCT No.: PCT/JP2017/012757

§ 371 (c)(1),
(2) Date: Jul. 16, 2019

(87) PCT Pub. No.: WO2018/179112

PCT Pub. Date: Oct. 4, 2018

(65) Prior Publication Data

US 2020/0217329 A1 Jul. 9, 2020

(51) Int. Cl.

| | |
|---|---|
| ***F04D 29/42*** | (2006.01) |
| ***F04D 29/40*** | (2006.01) |
| ***F04D 29/44*** | (2006.01) |

(52) U.S. Cl.

CPC ..... *F04D 29/4206* (2013.01); *F04D 29/403* (2013.01); *F04D 29/441* (2013.01);
(Continued)

(58) Field of Classification Search

CPC ... F04D 29/4206; F04D 29/443; F04D 29/441
See application file for complete search history.

(56) References Cited

U.S. PATENT DOCUMENTS

| | | | | |
|---|---|---|---|---|
| 9,366,265 | B2 * | 6/2016 | Tomita | F04D 29/4226 |
| 2013/0294903 | A1 | 11/2013 | Tomita et al. | |
| 2016/0319683 | A1 | 11/2016 | Yokoyama et al. | |

FOREIGN PATENT DOCUMENTS

| | | | |
|---|---|---|---|
| JP | 2002-202098 | A | 7/2002 |
| JP | 5439423 | B2 | 3/2014 |

(Continued)

OTHER PUBLICATIONS

Extended European Search Report for European Application No. 17903151.3, dated Dec. 12, 2019.

(Continued)

*Primary Examiner* — Christopher Verdier
*Assistant Examiner* — Cameron A Corday
(74) *Attorney, Agent, or Firm* — Birch, Stewart, Kolasch & Birch, LLP

(57) ABSTRACT

A scroll shape of a compressor forms into a spiral shape a flow path of fluid discharged from a diffuser provided on a downstream side of the compressor in a fluid flow direction. The scroll shape has a scroll outer diameter that is not constant in a circumferential direction. An increase degree of a ratio A/R is set to be increased in a range from a winding start position to a winding end position of a scroll portion where A is a passage cross-sectional area of the scroll portion and R is a radius from a center of the compressor to a center of a passage cross section of the scroll portion.

5 Claims, 9 Drawing Sheets

(52) U.S. Cl.
CPC ..... *F05D 2220/40* (2013.01); *F05D 2240/14* (2013.01); *F05D 2250/50* (2013.01)

(56) References Cited

FOREIGN PATENT DOCUMENTS

| | | | |
|---|---|---|---|
| JP | 2015-183670 | A | 10/2015 |
| JP | 5870083 | B2 | 2/2016 |
| JP | 6053993 | B1 | 12/2016 |
| WO | WO 2015/099199 | A1 | 7/2015 |

OTHER PUBLICATIONS

International Search Report and Written Opinion of the International Searching Authority, dated May 30, 2017, for International Application No. PCT/JP2017/012757, along with an English translation.

* cited by examiner

COMPRESSOR SCROLL SHAPE AND SUPERCHARGER

FIELD

The present invention relates to a scroll shape of a compressor in a supercharger in which a rotary shaft connects a turbine and the compressor, and a supercharger to which the scroll shape of the compressor is applied.

BACKGROUND

A flue gas turbine supercharger is configured by integrally connecting a compressor and a turbine by a rotary shaft and accommodating the compressor and the turbine in a housing in a rotatable manner. Flue gas is supplied into the housing to rotate the turbine, so that the rotary shaft is driven and rotated to rotationally drive the compressor. The compressor introduces the air from the outside, pressurizes the air by an impeller to provide compressed air, and supplies the compressed air to an internal combustion engine and the like.

In the above-mentioned flue gas turbine supercharger, the compressor as a centrifugal compressor is configured by fixing a plurality of blades to an outer circumferential portion of the compressor impeller and is accommodated in a compressor housing. The compressor housing has a diffuser, a scroll portion, and a discharge port provided on the outer circumferential side of the compressor. The diffuser has a substantially donut shape and decreases the velocity of fluid discharged from the compressor, thereby recovering static pressure. The scroll portion is formed on the outer circumferential side of the diffuser such that a passage cross-sectional area thereof is increased in a spiral manner in the circumferential direction and collects the fluid over the entire circumference. When the compressor rotates, the blades compress the fluid introduced through an air intake. Then, the compressed air is discharged to the diffuser from the outer circumferential side of the compressor, passes through the scroll portion, and is sent to the outside through the discharge port.

A conventional scroll portion has the passage cross-sectional area that is gradually increased from a tongue portion position at about 60° in the clockwise direction to a position at 360° when a scroll winding end position is 0° as a reference. An increase rate of the scroll passage cross-sectional area is designed such that a flow velocity is substantially constant in the circumferential direction at a design flow rate. When the scroll portion operates at a flow rate lower than the designed flow rate, the flow velocity in the vicinity of the tongue portion is increased with an effect of flow recirculating toward the tongue portion side from the scroll winding end side. As a result, the flow velocity is relatively decreased toward the downstream side. For example, the following Patent Literature 1 discloses the above-mentioned compressor.

CITATION LIST

Patent Literature

Patent Literature 1: Japanese Patent No. 5439423

SUMMARY

Technical Problem

FIG. 15 is a graph indicating a volumetric flow rate and a flow velocity for a scroll angle in a scroll shape of a conventional compressor.

As illustrated in FIG. 15, in the conventional compressor, the passage cross-sectional area of a scroll portion is gradually increased from a tongue portion position at about 60° to a position at 360° (dashed-dotted curve illustrated in FIG. 15). When the scroll portion operates at a flow rate lower than a designed flow rate, the flow velocity (solid line illustrated in FIG. 15) is gradually decreased with the above-mentioned recirculating effect. It has been, however, found by CFD analysis that actually, the flow velocity is increased, and then, is drastically decreased in a range of the scroll portion from a position beyond the tongue portion position at about 60° to around a position at 180° (alternate long and two short dashes curve illustrated in FIG. 15). This increase and decrease occurs because an effective flow path area of the scroll is decreased due to separation that has occurred in the scroll with the drastic decrease in the flow velocity and the flow velocity is locally increased.

As a result, lowering of efficiency and decrease in a surge margin can possibly occur. That is to say, separation of the fluid in the scroll portion is estimated to occur because as a result of extreme increase in the flow velocity at a winding start portion with a small passage cross-sectional area with generation of the recirculating flow, the velocity of the fluid is drastically decreased toward the downstream side in the circumferential direction from the scroll winding start portion.

With the above-mentioned scroll shape of the compressor disclosed in Patent Literature 1, in a range from the scroll winding start portion to the scroll winding end position, separation can occur with drastic decrease in the velocity and efficiency can be lowered due to mixture of the range with the decreased velocity and the range with the increased velocity.

The present invention has been made in order to solve such problems, and an object thereof is to provide a scroll shape of a compressor and a supercharger that improve efficiency while preventing occurrence of separation of fluid in a scroll portion.

Solution to Problem

To achieve the object described above, a scroll shape according to the present invention is a scroll shape of a compressor that forms into a spiral shape a flow path of fluid discharged from a diffuser provided on a downstream side of the compressor in a fluid flow direction. An increase degree of a ratio A/R is set to be increased in a range from a winding start position to a winding end position of a scroll portion where A is a passage cross-sectional area of the scroll portion and R is a radius from a center of the compressor to a center of a passage cross section of the scroll portion.

The scroll portion is designed such that the passage cross-sectional area is gradually increased from the winding start position to the winding end position and a flow velocity is substantially constant in the circumferential direction at a design flow rate. When the scroll portion operates at a flow rate lower than the designed flow rate, flow recirculating from the winding end position side to the winding start position side of the scroll portion is generated, and the flow velocity is increased on the upstream side and is decreased on the downstream side with increase in the passage cross-sectional area. Then, the flow velocity is drastically decreased on the downstream side relative to the winding start position of the scroll portion, and separation tends to occur in the scroll portion. To cope with this situation, the increase degree of the ratio A/R of the radius R relative to the passage cross-sectional area A is set to be increased in a range from the winding start position to the winding end position of the scroll portion. With this setting, the passage cross-sectional area is decreased to increase the flow velocity on the downstream side relative to the winding start position of the scroll portion. Difference in the flow velocity between the downstream side and the winding start position is therefore decreased, and a decrease rate of the flow velocity is moderated. As a result, the flow velocity is prevented from being drastically decreased on the downstream side relative to the winding start position of the scroll portion. Consequently, separation of the fluid from a wall surface of the scroll portion is prevented, and in particular, efficiency at a small flow-rate operation point can be improved.

In the scroll shape of the compressor according to the present invention, the increase degree of the ratio A/R is a change rate of the ratio A/R, and the change rate of the ratio A/R is set to be increased from the winding start position toward the winding end position of the scroll portion.

In this scroll shape, the change rate of the ratio A/R is set to be increased from the winding start position toward the winding end position of the scroll portion. With this setting, the passage cross-sectional area is decreased to increase the flow velocity on the downstream side relative to the winding start position of the scroll portion. The difference in the flow velocity between the downstream side and the winding start position is therefore decreased, and the decrease rate of the flow velocity is moderated. As a result, the flow velocity is prevented from being drastically decreased on the downstream side relative to the winding start position of the scroll portion, and separation of the fluid from the wall surface of the scroll portion can be prevented.

In the scroll shape of the compressor according to the present invention, in a graph in which a horizontal axis indicates range shift from the winding start position to the winding end position of the scroll portion and a vertical axis indicates the ratio A/R, a line shape of the ratio A/R has a downward convex shape projecting toward a zero side.

With this scroll shape, the flow velocity is prevented from being drastically decreased, and separation of the fluid from the wall surface of the scroll portion can be prevented.

In the scroll shape of the compressor according to the present invention, when an angle at the winding end position of the scroll portion is 0°, the line shape of the ratio A/R has the downward convex shape projecting toward the zero side in at least a range of about 60° to 240° shifted toward a winding start side of the scroll portion.

With this scroll shape, the flow velocity is prevented from being drastically decreased in at least a range on the winding start side of the scroll portion, and separation of the fluid from the wall surface of the scroll portion can be prevented.

In the scroll shape of the compressor according to the present invention, a range with a large increase degree of the ratio A/R and a range with a constant increase degree of the ratio A/R are set in the range from the winding start position to the winding end position of the scroll portion.

With this scroll shape, in the range with the large increase degree of the ratio A/R, the flow velocity is prevented from being drastically decreased and separation of the fluid from the wall surface of the scroll portion can be prevented. On the other hand, in the range with the constant increase degree of the ratio A/R, decrease in the flow velocity is prompted and increase in pressure loss with increase in the flow velocity can be decreased.

In the scroll shape of the compressor according to the present invention, there is no range with a small increase degree of the ratio A/R in the range from the winding start position to the winding end position of the scroll portion.

With this scroll shape, separation of the fluid from the wall surface of the scroll portion due to drastic fluctuation in the flow velocity can be prevented.

In the scroll shape of the compressor according to the present invention, the ratio A/R at the winding start position of the scroll portion is set to be equal to or higher than 20% of the ratio A/R at the winding end position of the scroll portion.

With this scroll shape, the flow velocity is prevented from being drastically decreased by increasing the passage cross-sectional area at the winding start position of the scroll portion, and separation of the fluid from the wall surface of the scroll portion can be prevented.

A scroll shape of a compressor according to the present invention is a scroll shape of a compressor that forms into a spiral shape a flow path of fluid discharged from a diffuser provided on a downstream side of the compressor in a fluid flow direction. A ratio A/R at a winding start position of a scroll portion is set to be equal to or higher than 20% of a ratio A/R at a winding end position of the scroll portion, and a ratio A/R is set to be increased from the winding start position toward the winding end position of the scroll portion where A is a passage cross-sectional area of the scroll portion and R is a radius from a center of the compressor to a center of a passage cross section of the scroll portion.

In this scroll shape, the ratio A/R of the radius R relative to the passage cross-sectional area A at the winding start position of the scroll portion is set to be equal to or higher than 20% of the ratio A/R at the winding end position. With this setting, the passage cross-sectional area at the winding start position of the scroll portion is increased. Difference in the flow velocity between the winding start position and the downstream side relative to the winding start position is therefore decreased, and the decrease rate of the flow velocity is moderated. As a result, the flow velocity is prevented from being drastically decreased on the downstream side relative to the winding start position of the scroll portion. Consequently, separation of the fluid from a wall surface of the scroll portion is prevented, and in particular, efficiency at a small flow-rate operation point can be improved.

In the scroll shape of the compressor according to the present invention, an increase degree of the ratio A/R is set to be constant in the range from the winding start position to the winding end position of the scroll portion.

With this scroll shape, decrease in the flow velocity is prompted, and increase in the pressure loss with increase in the flow velocity can be decreased.

A supercharger according to the present invention includes a housing that has a hollow shape; a rotary shaft that is rotatably supported on the housing; a turbine that is provided on one end portion of the rotary shaft in an axial direction, and a compressor that is provided on another end portion of the rotary shaft in the axial direction. A scroll portion of the compressor in the housing has the scroll shape of the compressor described above.

In the scroll portion of the compressor, the flow velocity is prevented from being drastically decreased on the downstream side relative to the winding start position of the scroll portion, separation of the fluid from the wall surface of the scroll portion is prevented, and in particular, efficiency at a small flow-rate operation point can be improved.

Advantageous Effects of Invention

A scroll shape and a supercharger of the present invention can improve efficiency while preventing occurrence of separation of fluid in a scroll portion.

DESCRIPTION OF EMBODIMENTS

Hereinafter, preferred embodiments of a scroll shape of a compressor and a supercharger according to the present invention will be described in detail with reference to the accompanying drawings. It should be noted that the embodiments do not limit the present invention, and when there are a plurality of embodiments, the present invention encompasses combinations of the embodiments.

First Embodiment

Figure 1:
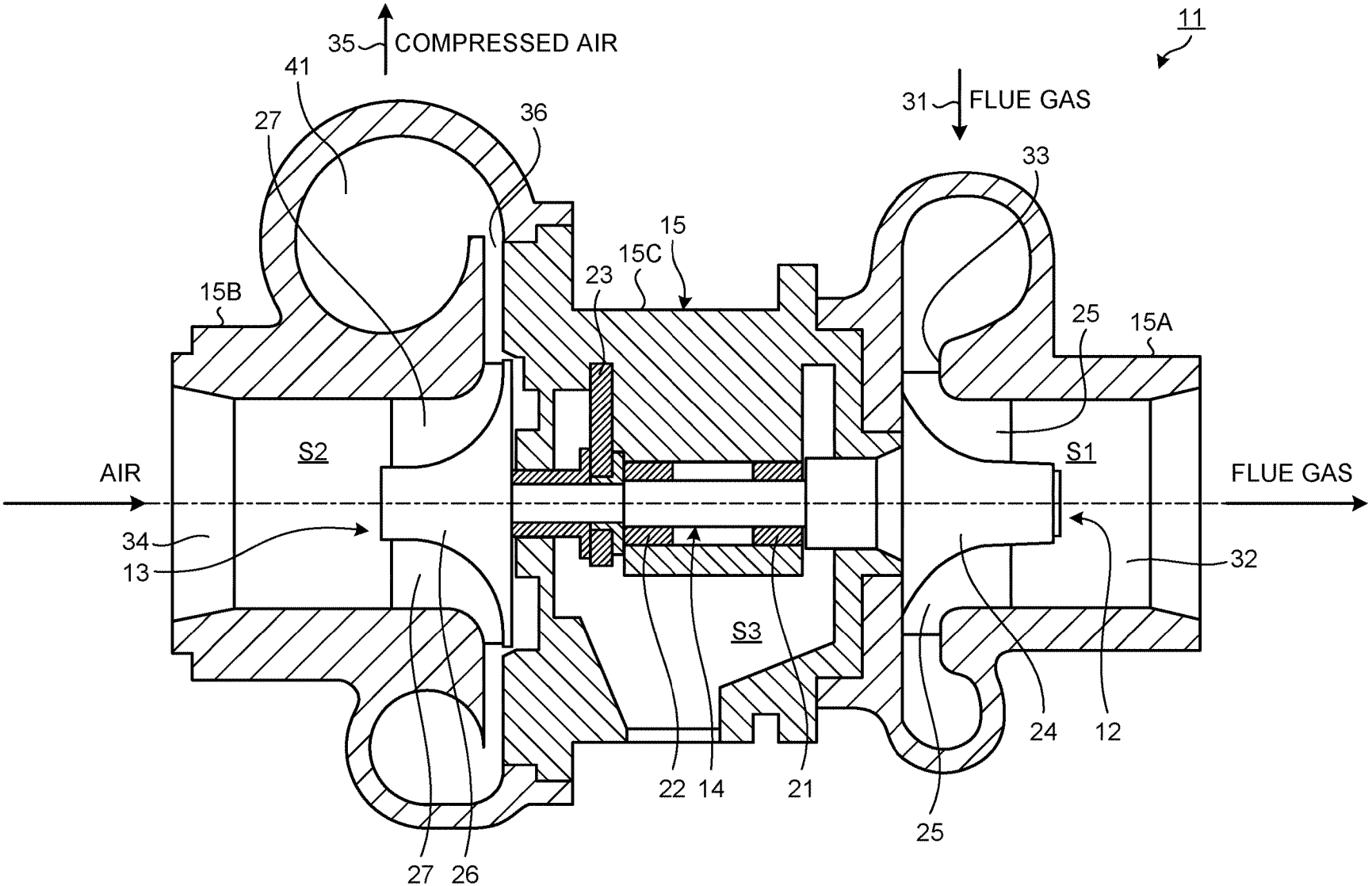
FIG. 1 is an overall configuration view illustrating a flue gas turbine supercharger according to a first embodiment.

FIG. 1 is an overall configuration view illustrating a flue gas turbine supercharger according to a first embodiment.

As illustrated in FIG. 1, a flue gas turbine supercharger 11 is mainly configured by a turbine 12, a compressor 13, and a rotary shaft 14, and they are accommodated in a housing 15.

The inside of the housing 15 is formed to be hollow, and the housing 15 has a turbine housing 15A forming a first space portion S1 accommodating therein components of the turbine 12, a compressor housing 15B forming a second space portion S2 accommodating therein components of the compressor 13, and a bearing housing 15C forming a third space portion S3 accommodating therein the rotary shaft 14. The third space portion S3 of the bearing housing 15C is located between the first space portion S1 of the turbine housing 15A and the second space portion S2 of the compressor housing 15B.

The rotary shaft 14 has an end portion on the turbine 12 side that is rotatably supported on a journal bearing 21 as a turbine-side bearing and an end portion on the compressor 13 side that is rotatably supported on a journal bearing 22 as a compressor-side bearing. A thrust bearing 23 restricts movement of the rotary shaft 14 in the axial direction in which the rotary shaft 14 extends. A turbine disc 24 of the turbine 12 is fixed to one end portion of the rotary shaft 14 in the axial direction. The turbine disc 24 is accommodated in the first space portion S1 of the turbine housing 15A and has a plurality of axial flow-type turbine vanes 25 that are provided on an outer circumferential portion thereof at predetermined intervals in the circumferential direction. A compressor impeller 26 of the compressor 13 is fixed to the other end portion of the rotary shaft 14 in the axial direction. The compressor impeller 26 is accommodated in the second space portion S2 of the compressor housing 15B and has a plurality of blades 27 that are provided on an outer circumferential portion thereof at predetermined intervals in the circumferential direction.

The turbine housing 15A has an entrance passage 31 of flue gas and an exit passage 32 of the flue gas that are provided for the turbine vanes 25. The turbine housing 15A has a turbine nozzle 33 that is provided between the entrance passage 31 and the turbine vanes 25. Flue gas flow in the axial direction that has been expanded by the turbine nozzle 33 under static pressure is guided to the turbine vanes 25, so that the turbine 12 can be driven and rotated. The compressor housing 15B has an air intake 34 and a compressed air discharge port 35 that are provided for the compressor impeller 26. The compressor housing 15B has a diffuser 36 provided between the compressor impeller 26 and the compressed air discharge port 35. The air compressed by the compressor impeller 26 is discharged after passing through the diffuser 36.

In the flue gas turbine supercharger 11, the turbine 12 is driven by the flue gas discharged from an engine (not illustrated), rotation of the turbine 12 is transmitted to the rotary shaft 14 to drive the compressor 13, and the compressor 13 compresses combustion gas and supplies it to the engine. Accordingly, the flue gas from the engine passes through the entrance passage 31 of the flue gas and is expanded by the turbine nozzle 33 under static pressure. The flue gas flow in the axial direction is then guided to the turbine vanes 25 to drive and rotate the turbine 12 through the turbine disc 24 to which the turbine vanes 25 are fixed. The flue gas that has driven the turbine vanes 25 is discharged to the outside through the exit passage 32. When the turbine 12 rotates the rotary shaft 14, the compressor impeller 26 integrated with the rotary shaft 14 rotates and the air is introduced through the air intake 34. The compressor impeller 26 pressurizes the introduced air to provide the compressed air, and the compressed air passes through the diffuser 36 and is supplied to the engine through the compressed air discharge port 35.

In the above-mentioned flue gas turbine supercharger 11, a scroll in the compressor 13 is provided as a scroll portion 41 having a substantially donut shape (spiral shape), which serves as a flow path of the compressed air (hereinafter, referred to as fluid), on the downstream side relative to the compressor impeller 26 in the compressor housing 15B, that is, on the outer circumferential side of the compressor impeller 26. The scroll portion 41 is formed on the outer circumferential side of the diffuser 36 such that the cross-sectional area thereof is increased in a spiral manner in the winding direction (direction in which the compressed air flows). The diffuser 36 decreases the velocity of the fluid discharged from the compressor impeller 26, thereby recovering the static pressure. Then, the scroll portion 41 decreases the velocity of the fluid and pressurizes the fluid. After that, the fluid is discharged to the outside through the compressed air discharge port 35.

Figure 2:
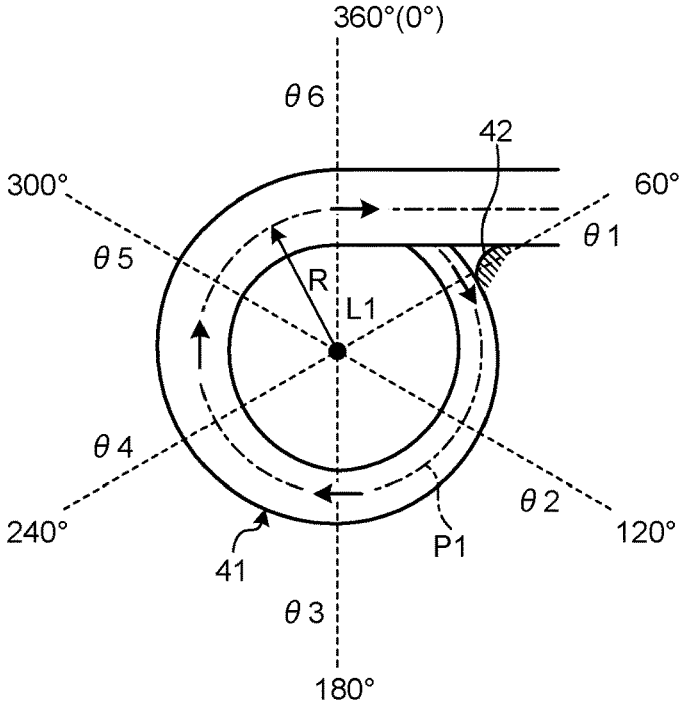
FIG. 2 is a schematic view illustrating a scroll shape of a compressor in the first embodiment.
Figure 3:
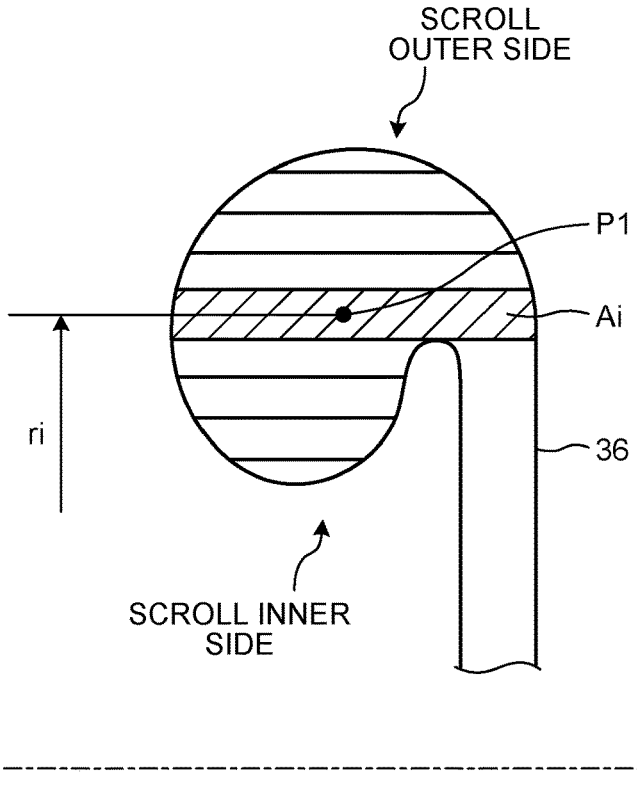
FIG. 3 is a cross-sectional view illustrating a scroll portion.
Figure 4:
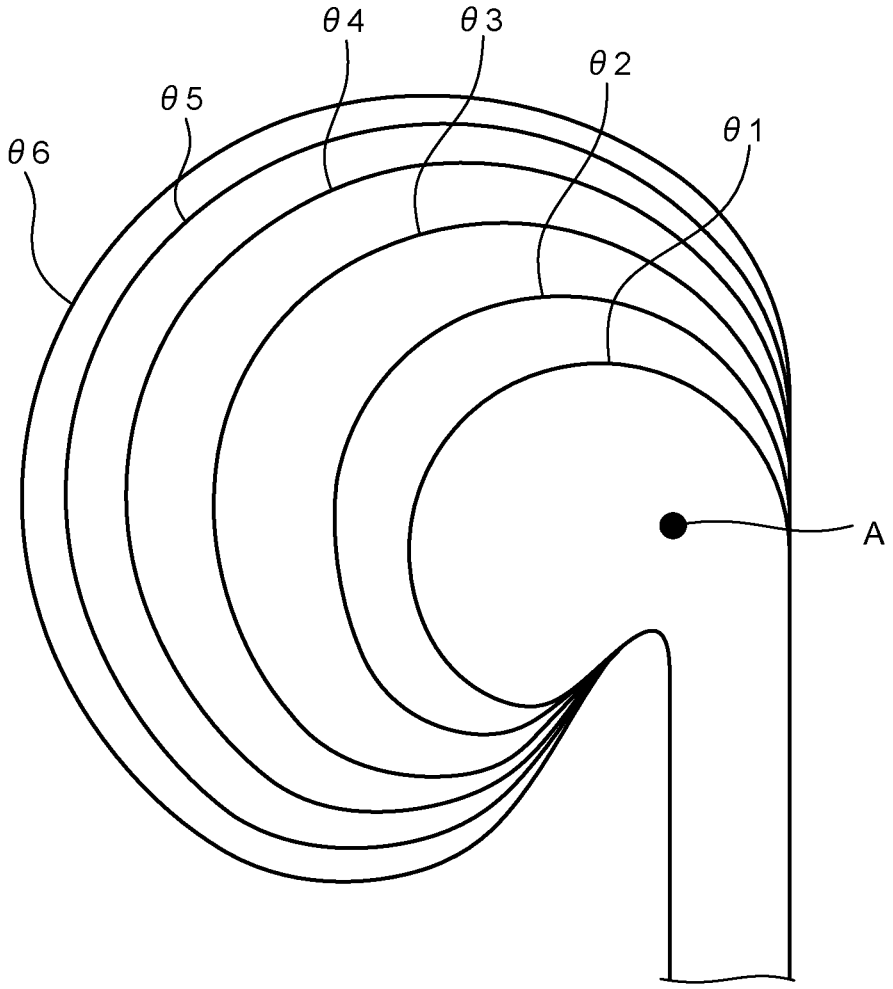
FIG. 4 is a schematic view illustrating the scroll portion.

The scroll shape of the compressor in the first embodiment will be described. FIG. 2 is a schematic view illustrating the scroll shape of the compressor in the first embodiment. FIG. 3 is a cross-sectional view illustrating the scroll portion. FIG. 4 is a schematic view illustrating the scroll portion.

As illustrated in FIG. 2, the scroll shape of the compressor in the first embodiment is designed such that the cross section of the scroll portion 41 in the radial direction has a substantially circular shape, and the passage cross-sectional area of the scroll portion 41 is gradually increased in a spiral manner in a range from a position at about 60° shifted in the winding direction (clockwise direction in FIG. 2) to a position at 360° at an end point (winding end position) Z of the scroll portion 41 when the end point Z) (360°) of the scroll portion 41 is 0° as a reference. The passage cross section is a plane of the scroll portion 41 that is orthogonal to a center line P1 along the fluid flow direction.

The scroll portion 41 has a tongue portion 42 that is provided in the vicinity of the position at about 60° in the winding direction. The tongue portion 42 is a site approximately consistent with a winding start position and is an end edge of a partition wall between the fluid discharged from the diffuser 36 and the fluid having flowed through the scroll portion 41.

The following equation is used under the condition that the fluid flowing in the scroll portion 41 normally has a constant angular momentum. It is assumed that the velocity in the circumferential direction is Vθ and the radius of the compressor impeller 26 is r.

$$V\theta \times r = \text{CONSTANT} \tag{1}$$

In this case, as is apparent from Equation (1), the velocity of the fluid on an inner side is greater than the velocity of the fluid on an outer side in the passage cross section at each site of the scroll portion 41 in the flow direction of the fluid. A volumetric flow rate Q of the fluid flowing in the scroll portion 41 therefore needs to be set in consideration of a size (shape) of the passage cross section and the radius of the scroll portion 41.

As illustrated in FIG. 3, the volumetric flow rate Q is calculated by Equation (1) and the following Equation (2) by dividing the passage cross section of the scroll portion 41 into band-like regions (cross-sectional area Ai) with a constant radius ri.

$$VOLUMETRICFLOWRATEQ = \sum_{i=1}^{n} Qi = \sum_{i=1}^{n} V_{\theta 1} Ai \tag{2}$$

From Equation (1), Vθi×ri=Vθ×r is satisfied.

$$V\theta i = V\theta \frac{r}{ri} \tag{3}$$

Then, Equation (3) is substituted into Equation (2).

$$Q = \sum_{i=1}^{n} V\theta \cdot \frac{r}{ri} \cdot Ai = V\theta_r \sum_{i=1}^{n} \frac{Ai}{ri} \tag{4}$$

From Equation (4), since Vθr indicates the velocity of the fluid discharged from the compressor impeller 26 in an outer circumferential portion of the diffuser 36 and is constant over the entire region of the outer circumferential portion of the diffuser 36, Vθr can be regarded as a constant that is determined in design.

Accordingly, Equation (5) is a value that takes areas along the passage cross-sectional shapes of the scroll portion 41 into consideration.

$$\sum_{i=1}^{n} \frac{r}{ri} \tag{5}$$

This equation is replaced as follows.

$$\sum_{i=1}^{n} \frac{Ai}{ri} = A/R \tag{6}$$

The volumetric flow rate Q in Equation (4) can be expressed as Equation (7).

$$Q = V\theta \cdot r \cdot A/R \tag{7}$$

When the volumetric flow rate Q of the fluid passing through each passage cross section of the scroll portion 41 is assumed to be constant in each passage cross section, a flow velocity V thereof is determined by a ratio A/R of a radius R relative to a passage cross-sectional area A. As the ratio A/R is increased, the flow velocity V is decreased. When the radius R is constant and the passage cross-sectional area A is decreased, the flow velocity V of the fluid flowing in the corresponding site is increased.

FIG. 4 is a sectional view displaying the passage cross-sectional areas at sites θ1 to θ6 in the winding direction (direction in which the fluid flows) of the scroll portion 41 in a laminated manner, and represents distribution when a cross-sectional area increase rate of the ratio A/R is varied. That is to say, FIG. 4 is a view when the cross-sectional areas at the sites θ1, θ2, θ3, θ4, θ5, and θ6 in the circumferential direction of the scroll portion 41, which are illustrated in FIG. 2, are laminated. The fluid from the compressor impeller 26 flows into the scroll portion 41 through the diffuser 36 over approximately the entire circumference of the scroll portion 41. In the embodiment, the ratio A/R on each passage cross section of the scroll portion 41 is increased with increase in the scroll angle θ.

Figure 5:
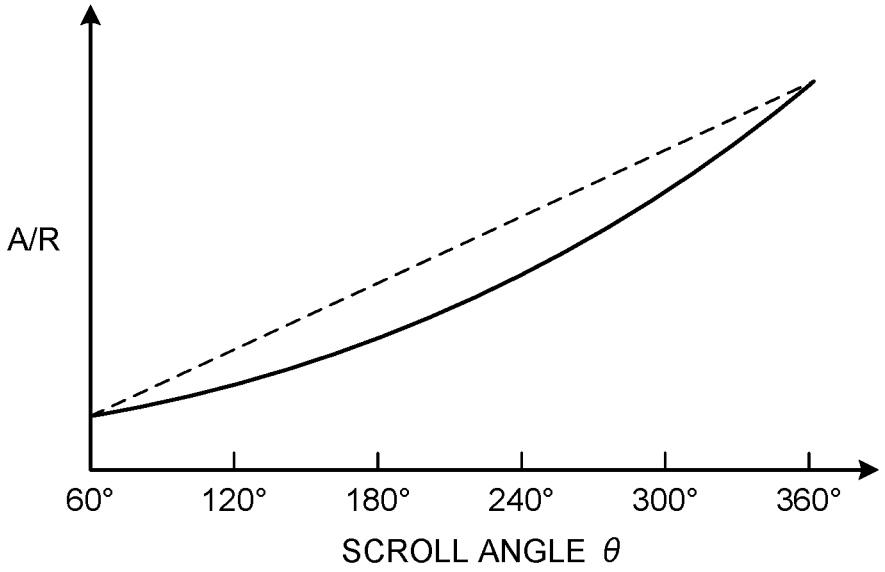
FIG. 5 is a graph indicating A/R for a scroll angle.
Figure 6:
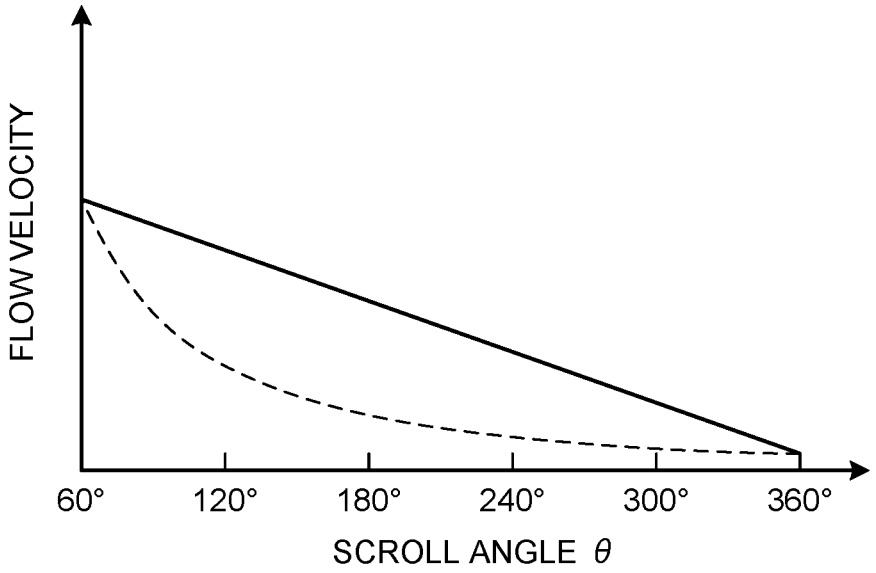
FIG. 6 is a graph indicating a flow velocity for the scroll angle.

FIG. 5 is a graph indicating the A/R for the scroll angle. FIG. 6 is a graph indicating the flow velocity for the scroll angle.

As illustrated in FIG. 2, the scroll shape of the compressor in the first embodiment is set such that the increase degree of the ratio A/R is increased in a range from the winding start position (position of the tongue portion 42) to the winding end position of the scroll portion 41 where the passage cross-sectional area of the scroll portion 41 is A and a radius from a center L1 of the compressor impeller 26 to a center (center line) P1 of the passage cross section of the scroll portion 41 is R.

That is to say, as illustrated in FIG. 5, the change rate of the ratio A/R as the increase degree of the ratio A/R is set to be increased with increase in the scroll angle θ from about 60° to 360° in a range from a position with the scroll angle θ of about 60° shifted in the winding direction with respect to the winding end position 0° of the scroll portion 41 to a position with the scroll angle θ of 360° at the winding end position of the scroll portion 41.

That is to say, when the horizontal axis indicates range shift from the winding start position (scroll angle θ of about 60°) to the winding end position (scroll angle θ of 360°) of the scroll portion 41 and the vertical axis indicates the ratio A/R, the line shape of the ratio A/R forms a downward convex shape projecting toward the 0 side. Conventionally, the line shape of the ratio A/R forms a straight line (dotted line) and the change rate of the ratio A/R is constant with increase in the scroll angle θ. On the other hand, the line shape of the ratio A/R in the first embodiment forms a concave shape (solid curve). There is no range with the small increase degree (change rate) of the ratio A/R in the range from the winding start position (scroll angle θ of about 60°) to the winding end position (scroll angle θ of 360°) of the scroll portion 41.

As illustrated in FIG. 6, the flow velocity with the conventional scroll shape, which is indicated by a dotted curve, is drastically decreased on the downstream side relative to the position with the scroll angle θ of about 60° in the range from the winding start position (scroll angle θ of about 60°) to the winding end position (scroll angle θ of 360°) of the scroll portion 41. Separation therefore tends to occur in a range of the scroll angle θ of about 60° to 180°. On the other hand, the flow velocity with the scroll shape in the embodiment, which is indicated by a solid line, is decreased at a substantially constant rate in the range from the winding start position (scroll angle θ of about 60°) to the winding end position (scroll angle θ of 360°) of the scroll portion 41. Separation is therefore unlikely to occur in a range on the downstream side relative to the position with the scroll angle θ of about 60°.

Figure 7:
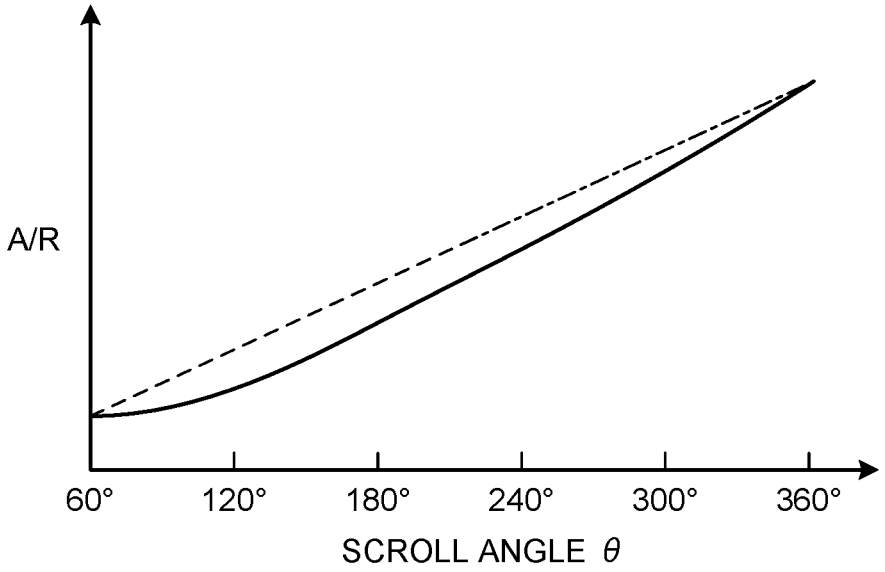
FIG. 7 is a graph indicating A/R for a scroll angle according to a modification of the first embodiment.
Figure 8:
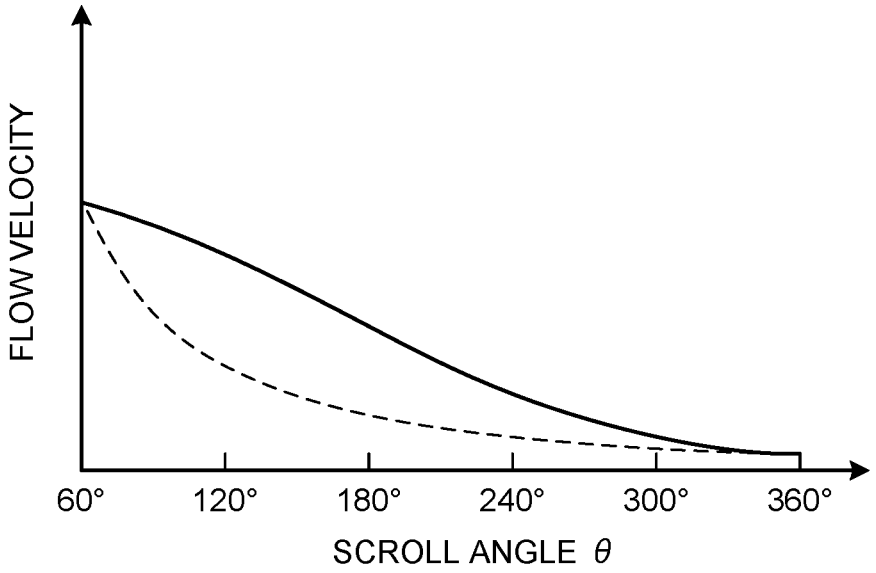
FIG. 8 is a graph indicating a flow velocity for the scroll angle in the modification of the first embodiment.

The change rate of the ratio A/R is not limited to the above-mentioned one in the shift range from the winding start position to the winding end position of the scroll portion 41. FIG. 7 is a graph indicating the A/R for the scroll angle in a modification of the first embodiment. FIG. 8 is a graph indicating the flow velocity for the scroll angle in the modification of the first embodiment.

As illustrated in FIG. 7, the scroll shape in the modification of the first embodiment is set such that the increase degree (change rate) of the ratio A/R is increased in a range from the position with the scroll angle θ of about 60° at the winding start position of the scroll portion 41 to a position with the scroll angle θ of 240° at the winding end position thereof. That is to say, the line shape of the ratio A/R forms a downward convex shape projecting toward the 0 side in at least a range from the position with the scroll angle θ of about 60° to the position with the scroll angle θ of 240°. The increase degree (change rate) of the ratio A/R is constant in a range from the position with the scroll angle θ of 240° to the position with the scroll angle θ of 360°, and the line shape of the ratio A/R therefore forms a straight line in the range. In this modification, the range with the large increase degree of the ratio A/R and the range with the constant increase degree of the ratio A/R are set in the range from the winding start position to the winding end position of the scroll portion 41. Even in this case, there is no range with a small increase degree (change rate) of the ratio A/R in the range from the winding start position to the winding end position of the scroll portion 41.

As illustrated in FIG. 8, the flow velocity with the conventional scroll shape, which is indicated by a dotted curve, is therefore drastically decreased on the downstream side relative to the position with the scroll angle θ of about 60° in the range from the winding start position (scroll angle θ of about 60°) to the winding end position (scroll angle θ of 360°) of the scroll portion 41. Separation therefore tends to occur in a range of the scroll angle θ of about 60° to 180°. On the other hand, the change rate in the flow velocity with the scroll shape in the embodiment, which is indicated by a solid curve, is decreased in the range from the winding start position (scroll angle θ of about 60°) to the winding end position (scroll angle θ of 360°) of the scroll portion 41. Separation is therefore unlikely to occur in this range.

As described above, in the scroll shape of the compressor in the first embodiment that forms, into a spiral shape, a flow path of the fluid discharged from the diffuser 36 provided on the downstream side of the compressor 13 in the fluid flow direction, the increase degree of the ratio A/R is set to be increased in the range from the winding start position to the winding end position of the scroll portion 41 where the passage cross-sectional area of the scroll portion 41 is A and the radius from the center L1 of the compressor impeller 26 to the center P1 of the passage cross section of the scroll portion 41 is R.

In this case, the increase degree of the ratio A/R is the change rate of the ratio A/R, and the change rate of the ratio A/R is set to be increased from the winding start position toward the winding end position of the scroll portion 41. To be specific, in the graph in which the horizontal axis is the range shift from the winding start position to the winding end position of the scroll portion 41 and the vertical axis is the ratio A/R, the line shape of the ratio A/R forms the downward convex shape projecting toward the 0 side.

The increase degree of the ratio A/R of the radius R relative to the passage cross-sectional area A is set to be increased in the range from the winding start position to the winding end position of the scroll portion 41. With this setting, the passage cross-sectional area is decreased to increase the velocity of the flow on the downstream side relative to the winding start position of the scroll portion 41. Difference in the flow velocity between the winding start position and the downstream side is therefore decreased, and the decrease rate of the flow velocity is moderated. As a result, the flow velocity is prevented from being drastically decreased on the downstream side relative to the winding start position of the scroll portion 41. Consequently, separation of the fluid from a wall surface of the scroll portion 41 is prevented, and in particular, efficiency at a small flow-rate operation point can be improved. The improvement in the efficiency at the small flow-rate operation point can enlarge a surge margin (operation range).

In the scroll shape of the compressor in the first embodiment, the line shape of the ratio A/R forms the downward convex shape projecting toward the 0 side in at least the range in which the scroll angle of the scroll portion 41 is about 60° to 240°. Accordingly, the flow velocity is prevented from being drastically decreased in at least the range on the winding start side of the scroll portion 41, and separation of the fluid from the wall surface of the scroll portion 41 can be prevented.

In the scroll shape of the compressor in the first embodiment, the range with the large increase degree of the ratio A/R and the range with the constant increase degree of the ratio A/R are set in the range from the winding start position to the winding end position of the scroll portion 41. Accordingly, in the range with the large increase degree of the ratio A/R, the flow velocity is prevented from being drastically decreased and separation of the fluid from the wall surface of the scroll portion 41 can be prevented. On the other hand, in the range with the constant increase degree of the ratio A/R, decrease in the velocity is prompted and increase in pressure loss with increase in the flow velocity can be decreased.

In the scroll shape of the compressor in the first embodiment, no range with the small increase degree of the ratio A/R is provided in the range from the winding start position to the winding end position of the scroll portion 41. Accordingly, separation of the fluid from the wall surface of the scroll portion 41 due to drastic fluctuation in the flow velocity can be prevented.

The supercharger in the first embodiment includes the housing 15 that has the hollow shape, the rotary shaft 14 that is rotatably supported on the housing 15, the turbine 12 that is provided on one end portion of the rotary shaft 14 in the axial direction, and the compressor 13 that is provided on the other end portion of the rotary shaft in the axial direction, in which the increase degree of the ratio A/R is set to be increased in the range from the winding start position to the winding end position of the scroll portion 41 in the scroll portion 41 of the compressor 13 in the housing 15.

In the scroll portion 41 of the compressor 13, the flow velocity is prevented from being drastically decreased at the scroll winding start position due to generation of recirculating flow of the fluid, separation of the fluid from the wall surface of the scroll portion 41 is prevented, and in particular, efficiency at the small flow-rate operation point can be improved.

Second Embodiment

Figure 9:
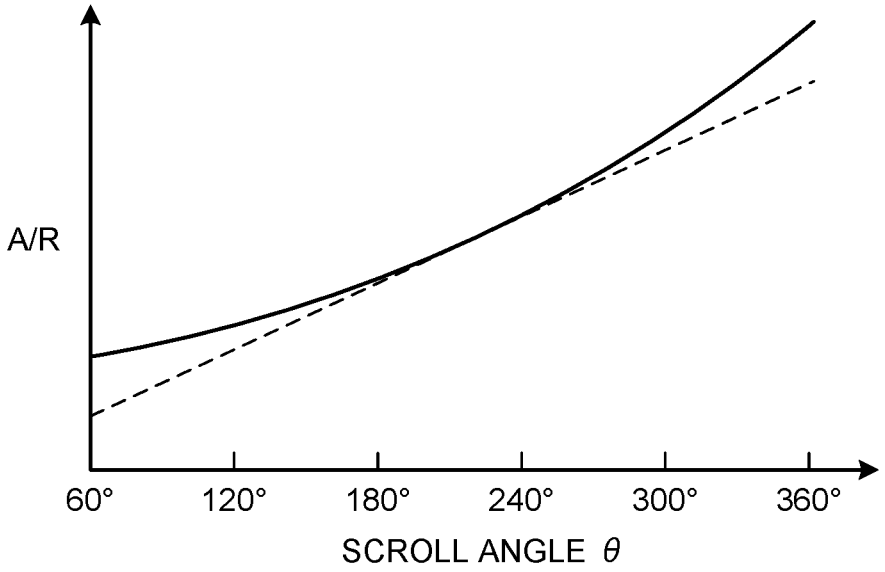
FIG. 9 is a graph indicating A/R for a scroll angle in a scroll shape of a compressor according to a second embodiment.
Figure 10:
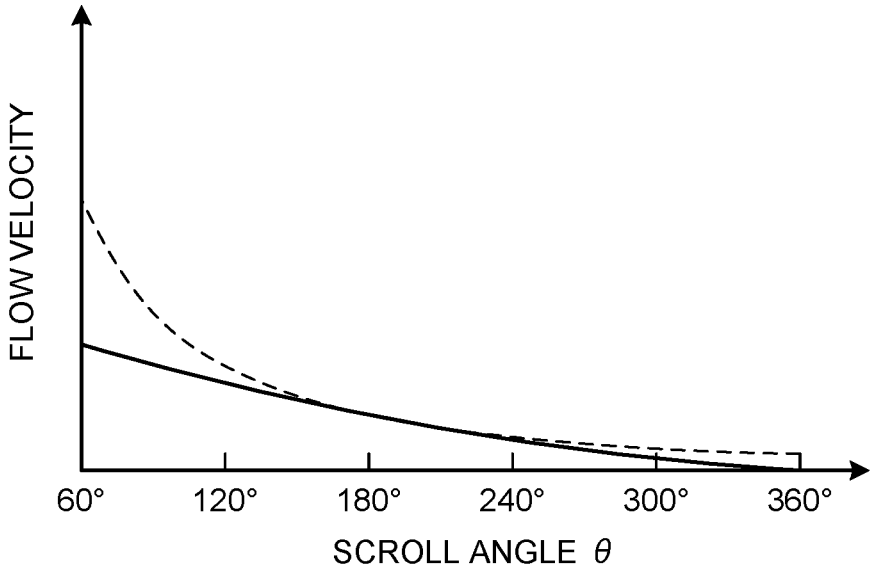
FIG. 10 is a graph indicating a flow velocity for the scroll angle in the scroll shape of the compressor in the second embodiment.

FIG. 9 is a graph indicating A/R for a scroll angle in a scroll shape of a compressor according to a second embodiment. FIG. 10 is a graph indicating a flow velocity for the scroll angle in the scroll shape of the compressor in the second embodiment.

As illustrated in FIG. 9, the scroll shape of the compressor in the second embodiment is set such that the increase degree (change rate) of the ratio A/R is increased in a range from a position with a scroll angle θ of about 60° at a winding start position of the scroll portion 41 to a position with the scroll angle θ of 360° at a winding end position thereof where a passage cross-sectional area of the scroll portion 41 is A and a radius from the center L1 of the compressor impeller 26 to the center P1 of a passage cross section of the scroll portion 41 is R.

That is to say, when the horizontal axis indicates range shift from the winding start position (scroll angle θ of about 60°) to the winding end position (scroll angle θ of 360°) of the scroll portion 41 and the vertical axis indicates the ratio A/R, the line shape of the ratio A/R forms a downward convex shape projecting toward the 0 side. Conventionally, the line shape of the ratio A/R forms a straight line (dotted line) and the change rate of the ratio A/R is constant with increase in the scroll angle θ. On the other hand, the line shape of the ratio A/R in the first embodiment forms a concave shape (solid curve).

The scroll shape of the compressor in the second embodiment is set such that the ratio A/R at the position with the scroll angle θ of about 60° at the winding start position of the scroll portion 41 is equal to or higher than 20% of the ratio A/R at the position with the scroll angle θ of 360° at the winding end position of the scroll portion 41. That is to say, the line shape (solid curve) of the ratio A/R in the scroll portion 41 in the first embodiment is set to be higher than the line shape (dotted line) of the ratio A/R in the conventional scroll portion in the range of the scroll angle θ of about 60° to 360°. A part of the line shape of the ratio A/R in the scroll portion 41 may be lower than the curve (dotted line) of the ratio A/R in the conventional scroll portion.

As illustrated in FIG. 10, the flow velocity in the case of the scroll shape in the embodiment, which is indicated by a solid line, therefore takes a lower value than the conventional flow velocity (dotted curve) at the winding start position (scroll angle θ of about 60°) of the scroll portion 41 and is decreased at a substantially constant rate in the range from the winding start position (scroll angle θ of about 60°) to the winding end position (scroll angle θ of 360°) of the scroll portion 41. Separation is therefore unlikely to occur in this range.

Figure 11:
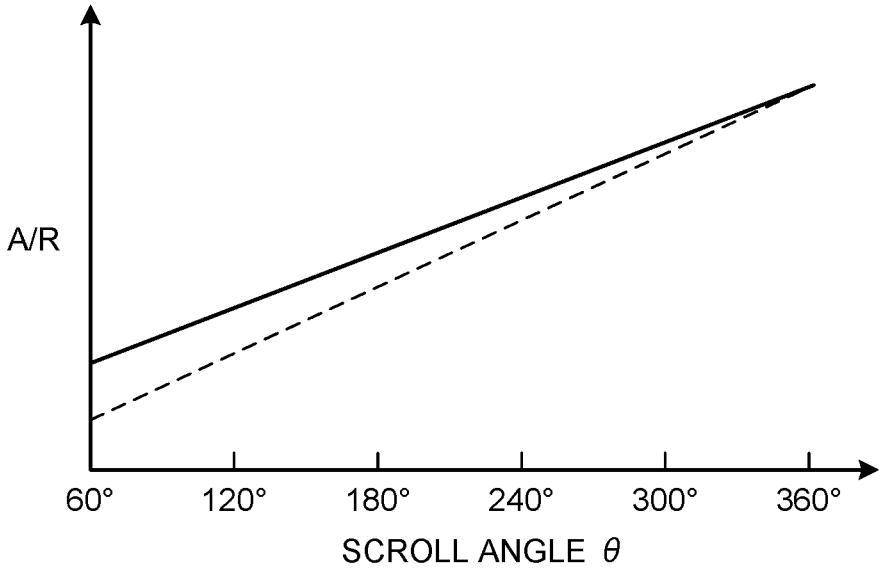
FIG. 11 is a graph indicating A/R for a scroll angle according to a modification of the second embodiment.
Figure 12:
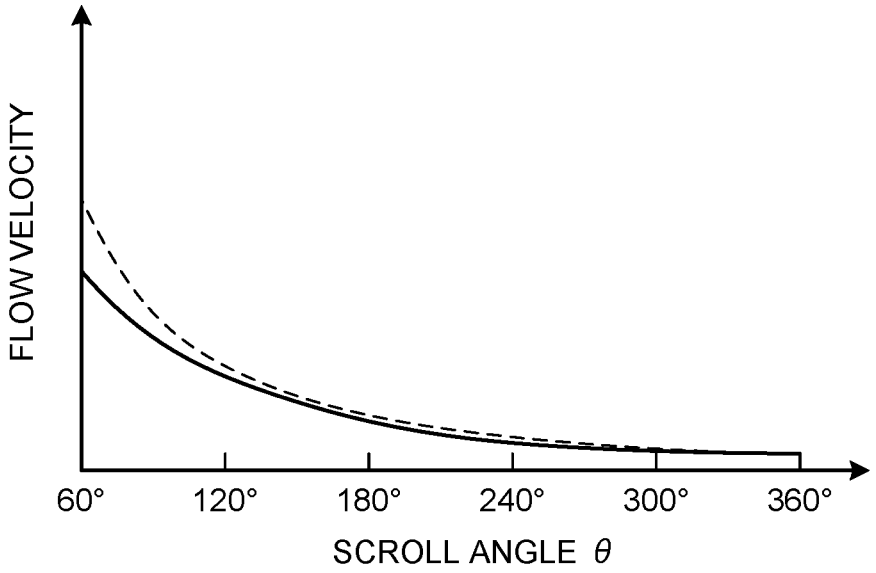
FIG. 12 is a graph indicating a flow velocity for the scroll angle in the modification of the second embodiment.

The change rate of the ratio A/R is not limited to the above-mentioned one in the shift range from the winding start position to the winding end position of the scroll portion 41. FIG. 11 is a graph indicating the A/R for the scroll angle in a modification of the second embodiment. FIG. 12 is a graph indicating the flow velocity for the scroll angle in the modification of the second embodiment.

As illustrated in FIG. 11, the scroll shape of the compressor in the modification of the second embodiment is set such that the increase degree (change rate) of the ratio A/R is constant in the range from the position with the scroll angle θ of about 60° at the winding start position of the scroll portion 41 to the position with the scroll angle θ of 360° at the winding end position thereof. The ratio A/R at the position with the scroll angle θ of about 60° at the winding start position of the scroll portion 41 is set to be equal to or higher than 20% of the ratio A/R at the position with the scroll angle θ of 360° at the winding end position of the scroll portion 41.

As illustrated in FIG. 12, the flow velocity in the case of the scroll shape in the embodiment, which is indicated by a solid curve, takes a lower value than the conventional flow velocity (dotted curve) at the winding start position (scroll angle θ of about 60°) of the scroll portion 41 and the change rate thereof is decreased in the range from the winding start position (scroll angle θ of about 60°) to the winding end position (scroll angle θ of 360°) of the scroll portion 41. Separation is therefore unlikely to occur in this range.

In the scroll shape of the compressor in the second embodiment, the ratio A/R at the winding start position of the scroll portion 41 is set to be equal to or higher than 20% of the ratio A/R at the winding end position of the scroll portion 41 and the ratio A/R is set to be increased from the winding start position toward the winding end position of the scroll portion 41 where the passage cross-sectional area of the scroll portion 41 is A and the radius from the center L1 of the compressor impeller 26 to the center P1 of the passage cross section of the scroll portion 41 is R.

The ratio A/R of the radius R relative to the passage cross-sectional area A at the winding start position of the scroll portion 41 is set to be equal to or higher than 20% of the ratio A/R at the winding end position. With this setting, the passage cross-sectional area at the winding start position of the scroll portion 41 is increased. Difference in the flow velocity between the winding start position and the downstream side is therefore decreased, and the decrease rate of the flow velocity is moderated. As a result, the flow velocity is prevented from being drastically decreased on the downstream side relative to the winding start position of the scroll portion 41. Consequently, separation of the fluid from the wall surface of the scroll portion 41 is prevented, and in particular, efficiency at a small flow-rate operation point can be improved.

Effects of Embodiments

Figure 13:
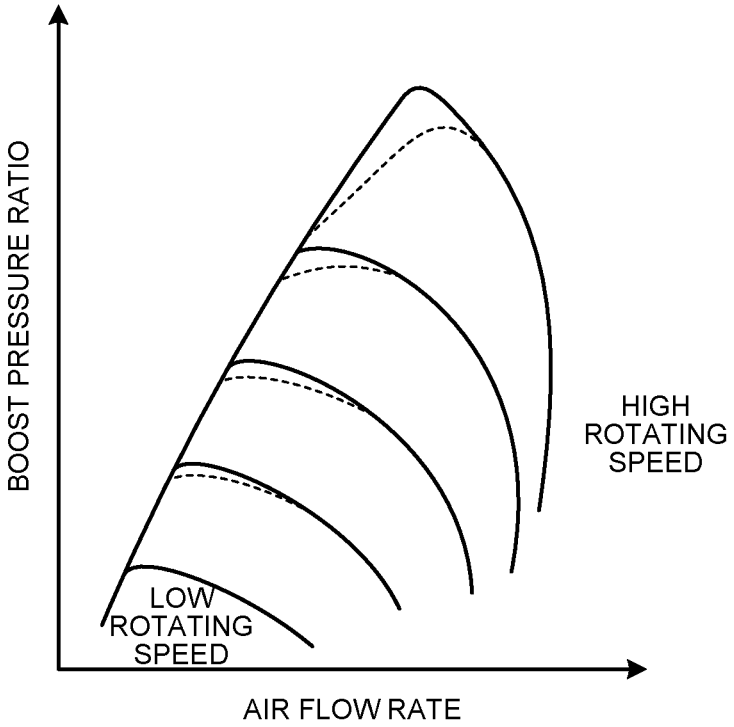
FIG. 13 is a graph indicating a supply air compression ratio for an air flow rate in the scroll shape of the compressor in the embodiment.
Figure 14:
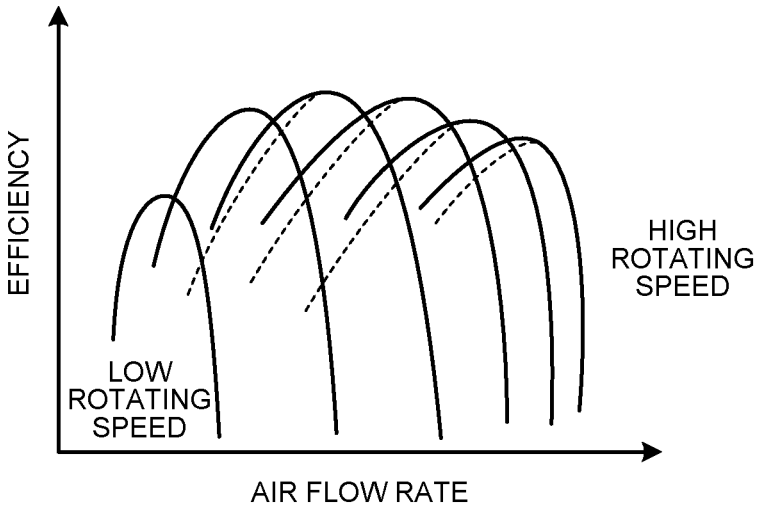
FIG. 14 is a graph indicating efficiency for the air flow rate in the scroll shape of the compressor in the embodiment.
Figure 15:
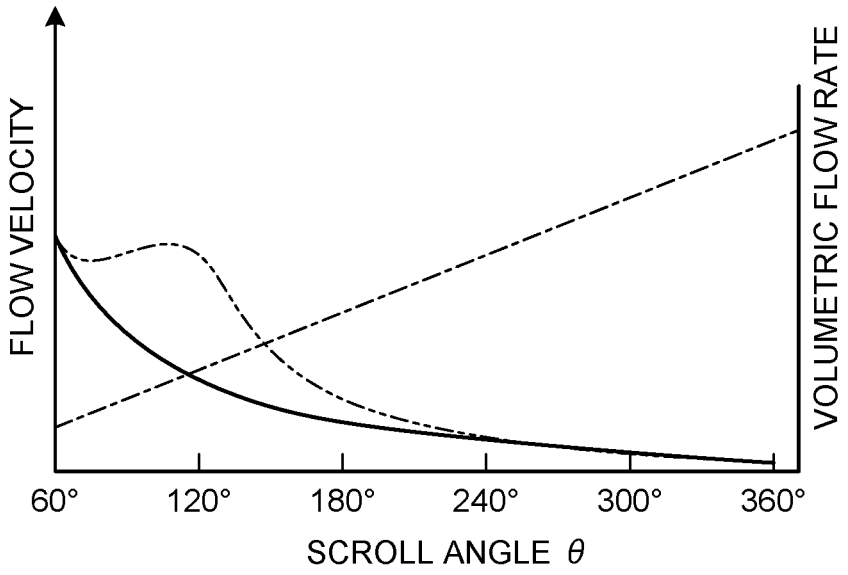
FIG. 15 is a graph indicating a volumetric flow rate and a flow velocity for a scroll angle in a scroll shape of a conventional compressor.

FIG. 13 is a graph indicating a supply air compression ratio for an air flow rate in the scroll shape of the compressor in the embodiment. FIG. 14 is a graph indicating efficiency for the air flow rate in the scroll shape of the compressor in the embodiment.

As illustrated in FIG. 13, as for the boost pressure ratio for the air flow rate, the boost pressure ratio in each of the first and second embodiments, which is indicated by solid curves, is improved particularly on the high rotating speed side and the operating range can be enlarged in comparison with the conventional boost pressure ratio, which is indicated by dotted curves. As illustrated in FIG. 14, as for the efficiency for the air flow rate, the efficiency in each of the first and second embodiments, which is indicated by solid curves, is improved particularly on the low flow rate side in comparison with the conventional efficiency, which is indicated by dotted curves.

In the above-mentioned embodiments, the ratio A/R of the radius R relative to the passage cross-sectional area A in the range from the winding start position to the winding end position of the scroll portion 41 is defined. The passage cross-sectional area A may however be defined.

REFERENCE SIGNS LIST

11 Flue gas turbine supercharger
12 Turbine
13 Compressor
14 Rotary shaft
15 Housing
21, 22 Journal bearing
23 Thrust bearing
24 Turbine disc
25 Turbine vane
26 Compressor impeller
27 Blade
34 Air intake
35 Compressed air discharge port
36 Diffuser
41 Scroll portion
42 Tongue portion

The invention claimed is:

1. A scroll shape of a compressor that forms into a spiral shape a flow path of fluid discharged from a diffuser provided on a downstream side of the compressor in a fluid flow direction, the scroll shape being formed such that a cross-sectional area of the scroll shape is increased in a spiral manner in a winding direction on an outer circumferential side of the diffuser, wherein an increase degree of a ratio NR is set to be continuously increased in a range from a winding start position to a winding end position of a scroll portion where A is a passage cross-sectional area of the scroll portion and R is a radius from a center of the compressor to a center of a passage cross section of the scroll portion, wherein in a graph in which a horizontal axis indicates range shift from the winding start position to the winding end position of the scroll portion and a vertical axis indicates the ratio NR, a line shape of the ratio NR is a continuous downward convex shape from the winding start position to the winding end position projecting toward a zero side, and wherein the ratio A/R at the winding start position of the scroll portion is set to be equal to or higher than 20% of the ratio A/R at the winding end position of the scroll portion.

2. The scroll shape of the compressor according to claim 1, wherein the increase degree of the ratio A/R is a change rate of the ratio A/R, and the change rate of the ratio A/R is set to be continuously increased from the winding start position toward the winding end position of the scroll portion.

3. The scroll shape of the compressor according to claim 1, wherein when an angle at the winding end position of the scroll portion is 0°, the line shape of the ratio A/R has the downward convex shape projecting toward the zero side in at least a range of 60° to 240° shifted toward a winding start side of the scroll portion.

4. The scroll shape of the compressor according to claim 1, wherein there is no range where the ratio A/R decreases in the range from the winding start position to the winding end position of the scroll portion.

5. A supercharger comprising:

a housing that has a hollow shape;

a rotary shaft that is rotatably supported on the housing;

a turbine that is provided on one end portion of the rotary shaft in an axial direction, and a compressor that is provided on another end portion of the rotary shaft in the axial direction, wherein a scroll portion of the compressor in the housing has the scroll shape of the compressor according to claim 1.

* * * * *